US010316630B2

(12) United States Patent
Clark

(10) Patent No.: US 10,316,630 B2
(45) Date of Patent: Jun. 11, 2019

(54) HYDROCARBON EXTRACTION TOOL AND PUMP ASSEMBLIES

(71) Applicant: Shawn D Clark, Shaunavon (CA)

(72) Inventor: Shawn D Clark, Shaunavon (CA)

( * ) Notice: Subject to any disclaimer, the term of this patent is extended or adjusted under 35 U.S.C. 154(b) by 0 days.

(21) Appl. No.: 15/832,434

(22) Filed: Dec. 5, 2017

(65) Prior Publication Data

US 2018/0156017 A1 Jun. 7, 2018

(51) Int. Cl.

| | |
|---|---|
| ***E21B 21/08*** | (2006.01) |
| ***E21B 43/12*** | (2006.01) |
| ***E21B 43/16*** | (2006.01) |
| ***E21B 43/26*** | (2006.01) |

(52) U.S. Cl.

CPC ..... *E21B 43/162* (2013.01); *E21B 21/08* (2013.01); *E21B 43/126* (2013.01); *E21B 43/26* (2013.01)

(58) Field of Classification Search

CPC ..... E21B 21/08; E21B 43/126; E21B 43/162; E21B 43/26; E21B 43/127; E21B 43/128; E21B 43/129; E21B 2043/125

See application file for complete search history.

(56) References Cited

U.S. PATENT DOCUMENTS

| | | | | | |
|---|---|---|---|---|---|
| 1,900,588 | A * | 3/1933 | Scott | F04B 47/00 | 417/450 |
| 2,753,940 | A * | 7/1956 | Bonner | E21B 43/26 | 166/150 |
| 3,209,834 | A * | 10/1965 | Essary | E21B 43/26 | 166/105 |
| 5,586,602 | A * | 12/1996 | Vagin | E21B 43/003 | 166/177.1 |
| 5,669,448 | A * | 9/1997 | Minthorn | E21B 33/12 | 166/177.5 |
| 6,439,307 | B1 * | 8/2002 | Reinhardt | E21B 49/082 | 166/169 |
| 2008/0264640 | A1 * | 10/2008 | Eslinger | E21B 43/128 | 166/308.1 |
| 2009/0084557 | A1 * | 4/2009 | Obrejanu | E21B 17/00 | 166/369 |
| 2011/0284238 | A1 * | 11/2011 | Berry | E21B 23/02 | 166/369 |
| 2013/0168099 | A1 * | 7/2013 | Themig | E21B 34/103 | 166/308.1 |

* cited by examiner

*Primary Examiner* — James G Sayre
(74) *Attorney, Agent, or Firm* — Michael J. Brown

(57) ABSTRACT

A novel tool for improving the efficiency of extraction of hydrocarbons from underground formations is described. The tool is configured to produce localized waves of high pressure fluid at a location within a wellbore. These pressure waves are effective to displace hydrocarbons within a geological formation such that enter the interior of the wellbore where they can be more easily removed by means of an accompanying pump assembly.

20 Claims, 4 Drawing Sheets

HYDROCARBON EXTRACTION TOOL AND PUMP ASSEMBLIES

PRIORITY

This application claims priority from Canadian application no. 2,950,523, filed Dec. 5, 2016.

FIELD OF INVENTION

This invention is in the field of hydrocarbon extraction from underground formations and tools and methods to improve the efficiency of extraction of hydrocarbons from wells.

BACKGROUND

In the early history of the oil and gas industry, the first sources of petroleum were reservoirs that naturally seeped to the earth's surface. In the course of coal mining operations in the 1850s, the existence of underground reservoirs of petroleum were discovered. These new reservoirs were easily accessible by simple drilling techniques, and the oil and gas extracted either by pumping, or free flowing to the surface by virtue of pressure within the reservoir itself.

Early oil reservoirs were generally close to the surface. With the development of modern geological sciences, it became apparent that oil and gas reservoirs existed deep within the earth's crust, and at multiple locations around the world.

More recently a variety of techniques have been developed to improve the ability to obtain oil and gas from geological formations that have been traditionally difficult to extract from. These include such formations as shales and other similar formations that contain large quantities of oil and gas that are trapped within the rock itself.

One technique that has been developed is the process of hydraulic fracturing, or "fracking." In this process, a wellbore is first drilled into an oil and gas containing formation. At regions within the target formation, the wellbore is perforated, and then high-pressure liquid injected into the well. The liquid can exit the wellbore through the perforations and enter the surrounding oil and gas formation. With sufficient hydraulic pressure, the rock in the formation is literally fractured, resulting in release of oil and gas into the spaces produced by the fracturing process. In order to improve the efficiency of the fracturing process, the fracturing liquid, typically water, may also contain one or more proppants such as sand or ceramics that function to keep the fracture open.

One of the limitations of current fracking technology is that is requires the use of significant quantities of water, which ultimately is then extracted from the wellbore as hydrocarbon contaminated waste water. Because of the potential for damage to the environment, contaminated fracking fluid is a challenging problem for the oil and gas industry. In addition, fracking operations may be limited, or even impossible, in areas without sufficient water supplies.

Thus, it would be an advantage to have a fracking tool that can produce the necessary disruption in an oil and gas formation to release otherwise unextractable hydrocarbons. It would also be an advantage to provide a tool that is able to fracture such formations while using substantially less fracturing fluid than is normally used using prior art tools and methods.

SUMMARY OF THE INVENTION

The present disclosure related to a combination fracking tool and pumping system for use in extracting hydrocarbon material from underground formations. In an exemplary embodiment, the tool comprises a sucker rod and cylinder in a casing that operates to pressurize the surrounding wellbore space in order to induce the release of material from a geological formation. The pumping portion of the system uses a spiral rod whose movement enhance fluid flow in the wellbore space that is effective to move material to the surface where it can be removed from the wellbore.

Thus, in some embodiments, there is provided a hydrocarbon extraction tool and pump combination for use in extracting material from an underground formation, comprising: a hydrocarbon extraction tool, the extraction tool comprising; a tool encasement, the tool encasement comprising a substantially cylindrical tube having a hollow interior, an enclosed end, and a rod insertion end; a sucker rod portion and cylinder portion, connected to each other sized to fit within the hollow interior space of the tool encasement, and to be moveable within the interior of the tool encasement; a pressure actuated port located within the tool encasement, the pressure actuated port configured to permit fluid flow from within the interior of the tool encasement outside into a surrounding wellbore space, when the fluid pressure within the interior of the tool casement exceeds a pre-determined value; a cylinder seal and a sucker rod seal, the cylinder seal and sucker rod seal configured to cooperatively isolate a portion of the volume of interior of the tool encasement from the remaining volume of the interior of the tool encasement and the surrounding wellbore space, wherein movement of the sucker rod and cylinder assembly within the tool encasement is effective to vary the volume and fluid pressure within the portion of the volume of the interior of the tool encasement thus isolated; a pump assembly, comprising; a pump encasement, the pump encasement comprising an elongate substantially hollow cylinder, sized to admit a spiral rod, the spiral rod configured to produce a fluid flow when rotated within the interior of the pump encasement, and wherein the interior of the pump encasement is fluid contact with the wellbore space surrounding the pump encasement; a drive mechanism, which engages the spiral rod and is operative to rotate the spiral rod in a desired direction, wherein rotation of the spiral rod is effective to produce a fluid flow within the wellbore space such that material is directed toward the end of the wellbore positioned at the surface of the earth.

In some embodiments, the pressure actuated port further comprising a nozzle body, with a nozzle opening therein, a shaft valve, and a bias member that produces a force effective to move the shaft valve into a position that occludes the nozzle opening, when the pressure differential between the wellbore space and the isolated volume within the tool encasement is less than a pre-determined value. In some embodiments, the bias member comprises a spring.

In some embodiments, the sucker rod seal comprises an opening sized to fit the circumference of sucker rod portion, and which is effective to substantially prevent the flow of material past the sucker rod seal. In some embodiments, the cylinder seal comprises a ring arranged circumferentially around the cylinder, and which is sized to engage the inner surface of the tool encasement, and which is effective to substantially prevent the flow of material past the cylinder seal.

In some embodiments, the drive mechanism comprises a motor housed within the pump encasement.

In some embodiments, the extraction tool, comprises a plurality of pressure actuated ports.

In some embodiments, the system comprises a plurality of pump assemblies linked end to end.

In some embodiments, the sucker rod portion and cylinder portion are formed from a contiguous piece of material. In some embodiments, the cylinder portion and sucker rod portion are separable.

There is also provide a method of extracting hydrocarbons from an underground formation, the method comprising: providing a hydrocarbon extraction tool, the extraction tool comprising; a tool encasement, the tool encasement comprising a substantially cylindrical tube having a hollow interior, an enclosed end, and a rod insertion end; a sucker rod portion and cylinder portion, connected to each other sized to fit within the hollow interior space of the tool encasement, and to be moveable within the interior of the tool encasement; a pressure actuated port located within the tool encasement, the pressure actuated port configured to permit fluid flow from within the interior of the tool encasement outside into a surrounding wellbore space, when the fluid pressure within the interior of the tool casement exceeds a pre-determined value; a cylinder seal and a sucker rod seal, the cylinder seal and sucker rod seal configured to cooperatively isolate a portion of the volume of interior of the tool encasement from the remaining volume of the interior of the tool encasement and the surrounding wellbore space, wherein movement of the sucker rod and cylinder assembly within the tool encasement is effective to vary the volume and fluid pressure within the portion of the volume of the interior of the tool encasement thus isolated; providing a pump assembly, comprising; a pump encasement, the pump encasement comprising an elongate substantially hollow cylinder, sized to admit a spiral rod, the spiral rod configured to produce a fluid flow when rotated within the interior of the pump encasement, and wherein the interior of the pump encasement is fluid contact with the wellbore space surrounding the pump encasement; a drive mechanism, which engages the spiral rod and is operative to rotate the spiral rod in a desired direction, wherein rotation of the spiral rod is effective to produce a fluid flow within the wellbore space such that material is directed toward the end of the wellbore positioned at the surface of the earth; placing the hydrocarbon extraction tool and at least one pump assembly into a wellbore in the vicinity of an underground formation from which hydrocarbons are to be extracted; operating the extraction tool to pressurizing the wellbore space such that hydrocarbon material is released the underground formation; operating the at least one pump assembly such that material in the wellbore space is moved towards the surface of the earth, where the material is removed from the wellbore prior to further processing.

In some embodiments of the method, the pressure actuated port further comprises a nozzle body, with a nozzle opening therein, a shaft valve, and a bias member that produces a force effective to move the shaft valve into a position that occludes the nozzle opening, when the pressure differential between the wellbore space and the isolated volume within the tool encasement is less than a predetermined value. In some embodiments of the method, the bias member comprises a spring.

In some embodiments of the method, the sucker rod seal comprises an opening sized to fit the circumference of sucker rod portion, and which is effective to substantially prevent the flow of material past the sucker rod seal.

In some embodiments of the method, the cylinder seal comprises a ring arranged circumferentially around the cylinder, and which is sized to engage the inner surface of the tool encasement, and which is effective to substantially prevent the flow of material past the cylinder seal.

In some embodiments of the method, the drive mechanism comprises a motor housed within the pump encasement.

In some embodiments of the method, the extraction tool comprises a plurality of pressure actuated ports.

In some embodiments, the method further comprises assembling plurality of pump assemblies linked end to end.

In some embodiments of the method, the sucker rod portion and cylinder portion are formed from a contiguous piece of material. In some embodiments of the method, the cylinder portion and sucker rod portion are separable.

BRIEF DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numerals, and where:

DETAILED DESCRIPTION OF THE PREFERRED EMBODIMENT

The present disclosure describes components of a system to improve extractability of hydrocarbons from underground geological formations. The disclosure is directed to a novel tool and pumping arrangement configured to release hydrocarbons from within a geological formation such that they flow into a wellbore, and then to move said hydrocarbons upwards in the wellbore where they can be removed at the surface.

Figure 1A:
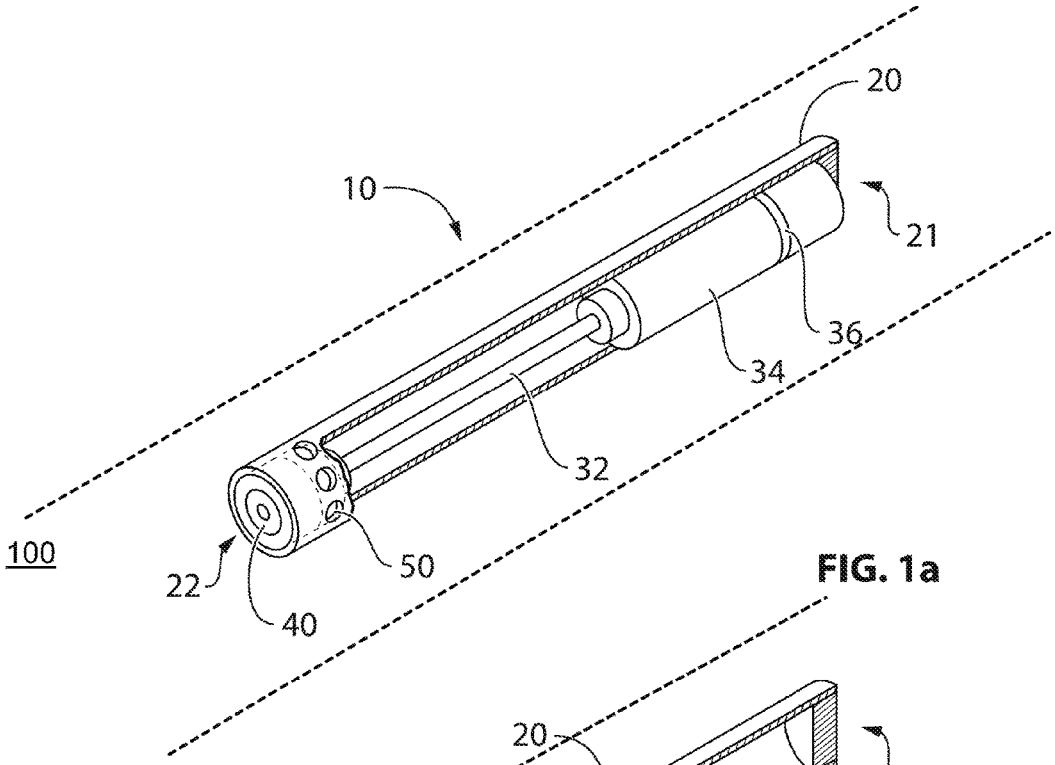
FIG. 1*a* depicts a perspective cutaway view of an embodiment of a hydrocarbon extraction tool and extraction pump of the present disclosure, where the cylinder is positioned at the bottom of its range of travel, and the hydrocarbon extraction tool and extraction pump is shown within a wellbore space.
Figure 1B:
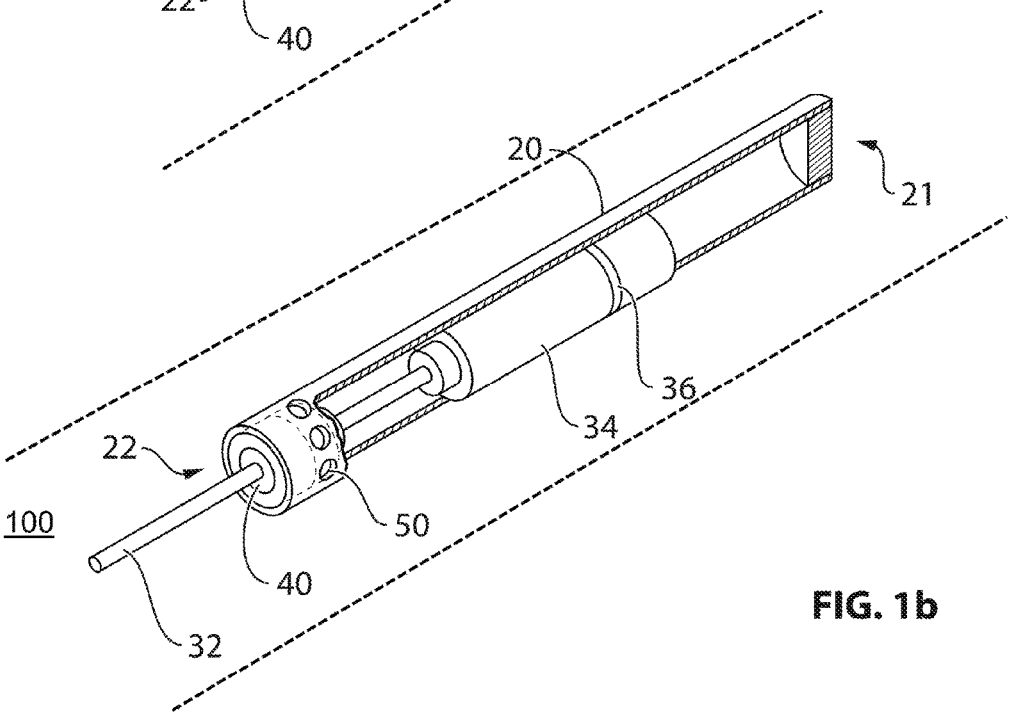
FIG. 1*b* depicts a perspective cutaway view of an embodiment of a hydrocarbon extraction tool and extraction pump of the present disclosure, where the cylinder is positioned partway put its range of travel, and the hydrocarbon extraction tool and extraction pump is shown within a wellbore space.
Figure 2:
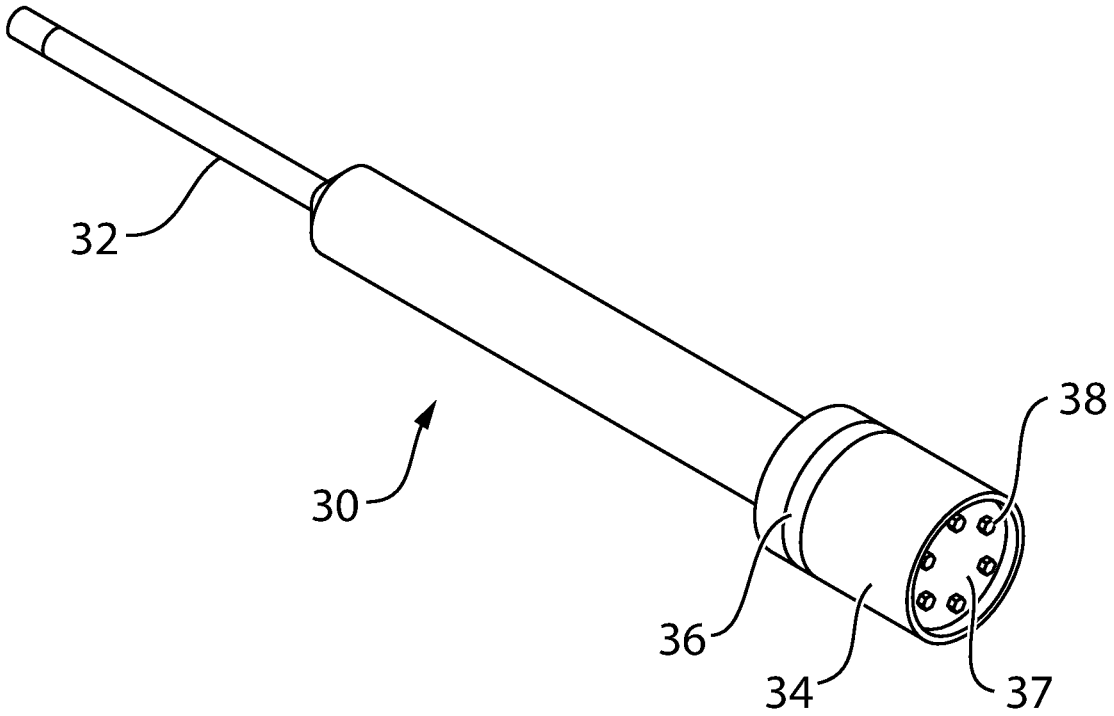
FIG. 2 depicts a perspective view of an embodiment of a sucker rod and cylinder assembly of the hydrocarbon extraction tool of the present disclosure.
Figure 3A:
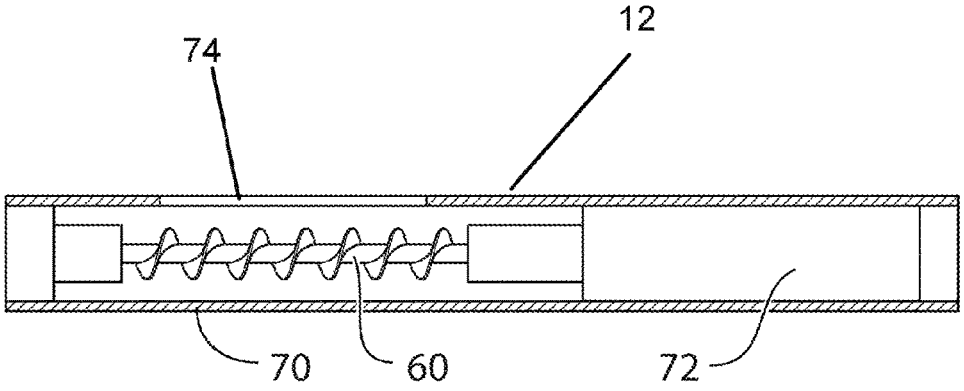
FIG. 3*a* depicts a side view of an embodiment of an extraction pump casing and spiral rod, of the present disclosure.
Figure 3B:
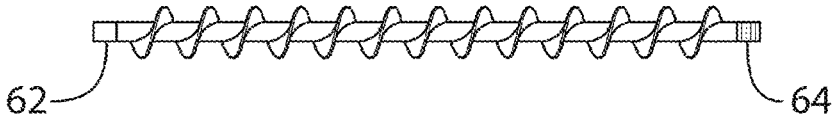
FIG. 3*b* depicts a side view of an embodiment of a spiral rod of the present disclosure.
Figure 4:
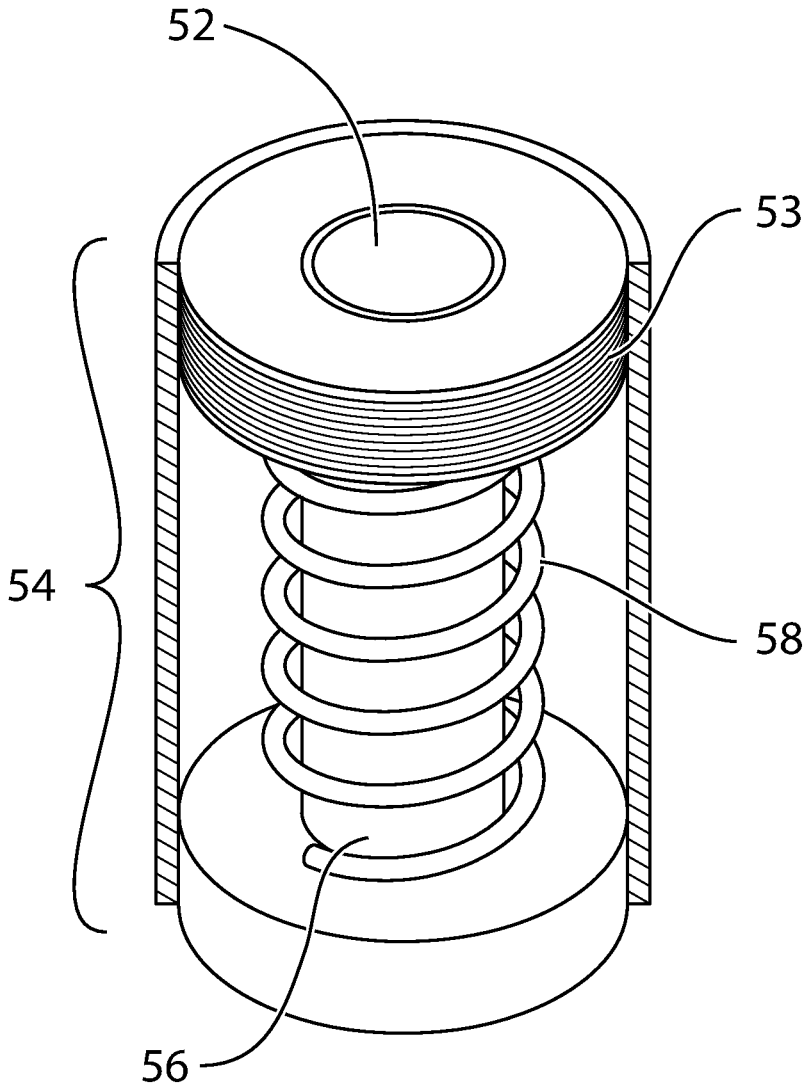
FIG. 4 depicts a side view of a spring-loaded pressure port of the present disclosure.

In one aspect, the invention comprises a novel tool, which may be described as a fracking tool 10, although in operation it is distinct from other fracking tools known in the prior art. As shown in FIGS. 1*a* and 1*b*, the tool comprises an outer tool encasement 20, a sucker rod and cylinder assembly 30, end seal 40 and pressure ports 50. The tool 10 is shown placed within wellbore space 100. The pumping portion 12 of the combination, shown in FIGS. 3*a* and 3*b*, comprises a pump encasement 70 that is substantially hollow, and within in which is positioned an elongated spiral rod 60 similar to an auger. The spiral rod is designed to move back and forth within the interior of the pump in order to create a directional flow of material to towards the surface of the wellbore. FIGS. 2-4, inclusive, provide additional details as to the components of the present invention. The tool encasement includes a closed end 21, and a rod insertion end 22, the insertion end permitting the insertion of the sucker rod and cylinder assembly into the interior space of the tool encasement.

FIG. 2 depicts and embodiment of the sucker rod and cylinder assembly 30 that forms part of the fracking tool. The sucker rod 32 is an elongate structure having at one end a larger caliber portion, or cylinder 34, that is very close in diameter to the inner diameter of the tool encasement 20. This cylinder can further include a seal portion 36 such that the seal portion maintains contact with the inner surface of the tool encasement, much like a piston that is able to move up and down within a cylinder of an internal combustion engine. The seal can be in the form of one or more rings made of rubber, metal or other suitable material such that is able to substantially prevent fluid flow past the piston as it moves up and down the inner bore of the tool encasement.

In some cases, the cylinder portion and remainder of the rod may be formed from a single piece of material. In other cases, it may be advantageous to provide a cylinder and remainder of the rod in two or pieces that can be mated and unmated as needed. For example, and as shown in FIG. 2, the cylinder may be fashioned such that it can be threaded onto the remainder of the rod by a threaded bottom plate 37 or other similarly functioning structure. For security, the cylinder may also be fastened to the remainder of the rod with one or more locking bolts 38. Having a removable cylinder provides additional advantages in terms of maintenance. Since the cylinder when in operation will move up and down the cylinder, it will be subject to wear, as will the components that along with the cylinder form the fluid seal that contacts in the inner bore of the tool encasement.

The end of the rod opposite the cylinder will be narrow and will move freely within the bore of the tool encasement and generally will not contact the inner bore of the tool encasement. This end may also include a locking coupler 39 or other similar assembly to enable the rod to attach to a device configured to move the rod back and forth within the tool encasement.

In addition to the fracking tool the present disclosure also includes a pump assembly 12 that is designed to move the material liberated by the fracking tool towards the top of the wellbore where it can ultimately be recovered. FIG. 3*a* depicts components of an embodiment of a pump assembly comprising a spiral rod 60 (e.g., auger or screw) within a pump encasement 70. FIG. 3*b* shows an embodiment of a spiral rod removed from the pump assembly. As can be seen, the pump encasement includes one or more openings 74 to permit fluid within the wellbore to flow into the interior of the pump encasement. Within the pump encasement is inserted the spiral pump rod which operates to move fluid within the pump when actuated in a back and forth motion.

In some cases, it may be desirable to assemble a chain of pumping assemblies to provide for movement of greater volumes of the contents of the wellbore in a defined time-period. To accomplish this, one end of the spiral rod may include a threaded rod coupler 62 while the other end includes a structure that can engage the rod coupler of the next spiral rod in the series. In some embodiments, the rod coupler and complimentary end may include complimentary threads so that two or more spiral rods can be threaded together to form a chain of pump assembles. It will also be apparent to those of skill in the art that the pump casing will include structures like bushings, bearings or other low friction portion to both suspend the spiral rod generally within the center of the bore of the pump casing, and to permit free rotation of the spiral rod when the pump is in operation. The pump will also include some form of either remote or contained means for inducing rotation of the spiral rod so that the assembly creates a directional flow of fluid within the wellbore casing. In some cases, the pump assembly may further comprise a motor 72 component to drive the spiral rod, for example an electric motor, or a turbine driven by a fluid stream.

While one end of the tool is open, the opposite end includes an assembly that in cooperation with the motion of the rod directs pressurized fluid towards the wall of the wellbore casing, in order to pressurize the geological formation and induce the movement of hydrocarbons from the regions surrounding the wellbore into the interior of the wellbore for eventual extraction. As can been seen in FIGS. 1A, 1B, and 4 one end of the tool comprises an assembly including a seal and pressure activated ports, the ports being the route through which material exits the tool into the wellbore.

In one embodiment, the top tube assembly is connected to the top of the encasement structure by a threaded connector. The top tube assembly further comprises an end seal 40, the opening of which is sized to fit snugly around the smaller end of the sucker rod. The top tube assembly also include one or more pressure-actuated ports, which in some cases can be one or more spring-loaded valves that open and close depending on the pressure differential between the inside of the tool encasement, and the surrounding wellbore environment. Of note, the upper end of the rod is fashioned with two different diameters. A first diameter is matched to the size of the opening in the top tube assembly of the encasement rod such that when this portion of the rod engages the seal at top end of the tool encasement. The most distal end of the rod is of a smaller diameter, such that when the rod is positioned so that this portion of the rod is in the region encompassed by the end seal, a gap around exists, allowing fluid from the wellbore to enter the interior of the tool encasement.

FIG. 4 depicts a more detailed view of an embodiment of a pressure actuated port 50 mechanism. In the depicted embodiment, the port comprises a more or less cylindrical nozzle body 54 portion, with a nozzle opening 52 passing completely through the center of the nozzle body. The structure can be designed with threaded portions 53 such that each port can be threaded into a corresponding threaded hole in the side of the tool encasement. The port further comprises a valve shaft 56 and bias member 58 arrangement. The bias member exerts a force on the valve shaft such that it will occlude the nozzle opening when the valve is in the closed configuration. In some embodiments, the bias member comprises a spring. The force exerted by the bias member is selected to provide resistance and maintain the port in a closed configuration when the pressure differential between the inside of the tool and the surrounding wellbore is below a certain value.

In operation, the system effectively operates as a reciprocating pump to cyclically generate high pressure at a discrete location within a well bore. As the sucker rod assembly is pushed into the tool encasement, fluid flows from the surrounding wellbore environment into the interior of the encasement through the gap surrounding the seal that is formed when the narrow portion of the sucker rod is within the region encompassed by the seal. Once the cylinder end of the sucker rod has reached the end of its range of travel, the sucker rod can then be pulled on thus causing the cylinder to move upwards towards the seal and pressure port end of the encasement. As the cylinder travels upwards, eventually the thicker portion of the sucker rod that lies between the cylinder and the narrow end of the rod will move into the seal portion of the assembly and engage the seal. Continuing to pull the sucker rod will cause the cylinder to continue to move upwards within the inner bore of the tool encasement. However, at this point, the volume between the cylinder the top end of the assembly is effectively contained between the top seal and the seal formed by the cylinder with the inner bore of the casement. Thus, as the sucker rod is continued to be pulled out of the encasement, and the cylinder continues to be moved upwards towards the pressure port end of the tool, the volume will be decreased and fluid pressure inside the tool will increase accordingly. Eventually the pressure inside the tool will be sufficient to overcome the spring-loaded valves that maintain the pressure ports close, the valves will open, the pressurized fluid will escape through the open pressure ports, and cause a corresponding increase in pressure in the vicinity of the fracking tool. This increase in pressure will be sufficient to cause localized fracturing of the surrounding formation, and/or create a pressure differential sufficient to displace hydrocarbons present in the geological formation such that they move into the wellbore where they can be more easily extracted.

Once the pressure is relieved by outflow of the contents of the tool into the surrounding wellbore environment, the pressure between the inside of the tool and the wellbore environment will equalize. The process can then be repeated by pushing the sucker rod back into the tool encasement in order to refill in the inside of tool, and then repeating the cycle. In this way, a series of pressure waves can be unleashed on the formation that can be continued in an ongoing fashion. This will result in cyclic release of hydrocarbons into the wellbore, which can then be extracted, the extraction aided by the pump assembly which will generally be located between the fracking tool and the opening of the wellbore at the earth's surface. In some embodiments, the fracking tool and spiral rod of the pump will be operated by connecting them through a chain of rods to a pumpjack or other similar machinery positioned at the opening of the wellbore at the earth's surface.

Table 1 presents predicted performance of the present invention as a function of various combinations of tubing size, rod size, and nozzle size, as well as pressure (in MPa) that can be generated by the present system. These are exemplary data based on calculations of mechanical efficiency and are not intended to limit the scope of the invention.

It will be recognized that the specific materials used in constructing the various components of the system described herein, are not considered to be limiting to the scope of the invention. Those of skill in the art will readily recognize and, be able to, select materials and components that will accomplish the objectives of the invention without requiring any inventive skill. It should also be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

TABLE 1

| Tubing Size (inches) | Rod Size (inches) | Nozzle Size | Bbl/Stk | Pressure (85% efficiency) |
|---|---|---|---|---|
| 2⅜" | ¾" | 18/32 | 0.46 | 10.01 |
| 2⅞" | ¾" | 18/32 | 0.67 | 14.58 |
| 3½" | 1" | 18/32 | 1.08 | 23.50 |
| 4" | 1" | 18/32 | 1.43 | 31.12 |
| 4½" | 1" | 18/32 | 1.80 | 39.17 |
| 2⅜" | ¾" | 24/32 | 0.46 | 7.51 |
| 2⅞" | ¾" | 24/32 | 0.67 | 10.93 |
| 3½" | 1" | 24/32 | 1.08 | 17.63 |
| 4 | 1" | 24/32 | 1.43 | 23.34 |
| 4½" | 1" | 24/32 | 1.80 | 29.38 |
| 2⅜" | ¾" | 12/32 | 0.46 | 15.01 |
| 2⅞" | ¾" | 12/32 | 0.67 | 21.87 |
| 3½" | 1" | 12/32 | 1.08 | 35.25 |
| 4 | 1" | 12/32 | 1.43 | 46.67 |
| 4½" | 1" | 12/32 | 1.80 | 58.75 |

What is claimed is:

1. A hydrocarbon extraction tool and pump combination for use in extracting material from an underground formation, comprising:

a hydrocarbon extraction tool comprising;

a tool encasement, the tool encasement comprising a substantially cylindrical tube having a hollow interior, an enclosed end, and a rod insertion end;

a sucker rod portion and cylinder portion, connected to each other sized to fit within the hollow interior space of the tool encasement, and to be moveable within the interior of the tool encasement;

a pressure actuated port located within the tool encasement, the pressure actuated port configured to permit fluid flow from within the interior of the tool encasement outside into a surrounding wellbore space, when the fluid pressure within the interior of the tool casement exceeds a pre-determined value; and a cylinder seal and a sucker rod seal, the cylinder seal and sucker rod seal configured to cooperatively isolate a portion of the volume of interior of the tool encasement from the remaining volume of the interior of the tool encasement and the surrounding wellbore space, wherein movement of the sucker rod and cylinder assembly within the tool encasement is effective to vary the volume and fluid pressure within the portion of the volume of the interior of the tool encasement thus isolated; and a pump assembly comprising;

a pump encasement, the pump encasement comprising an elongate substantially hollow cylinder, sized to admit a spiral rod, the spiral rod configured to produce a fluid flow when rotated within the interior of the pump encasement, and wherein the interior of the pump encasement is fluid contact with the wellbore space surrounding the pump encasement; and a drive mechanism, which engages the spiral rod and is operative to rotate the spiral rod in a desired direction, wherein rotation of the spiral rod is effective to produce a fluid flow within the wellbore space such that material is directed toward the end of the wellbore positioned at the surface of the earth.

2. The hydrocarbon extraction tool and pump combination of claim 1, the pressure actuated port further comprising a nozzle body, with a nozzle opening therein, a shaft valve, and a bias member that produces a force effective to move the shaft valve into a position that occludes the nozzle opening, when the pressure differential between the wellbore space and the isolated volume within the tool encasement is less than a pre-determined value.

3. The hydrocarbon extraction tool and pump combination of claim 2, wherein the bias member comprises a spring.

4. The hydrocarbon extraction tool and pump combination of claim 1, wherein the sucker rod seal comprises an opening sized to fit the circumference of sucker rod portion, and which is effective to substantially prevent the flow of material past the sucker rod seal.

5. The hydrocarbon extraction tool and pump combination of claim 1, wherein the cylinder seal comprises a ring arranged circumferentially around the cylinder, and which is sized to engage the inner surface of the tool encasement, and which is effective to substantially prevent the flow of material past the cylinder seal.

6. The hydrocarbon extraction tool and pump combination of claim 1, wherein the drive mechanism comprises a motor housed within the pump encasement.

7. The hydrocarbon extraction tool and pump combination of claim 1, comprising a plurality of pressure actuated ports.

8. The hydrocarbon extraction tool and pump combination of claim 1, comprising a plurality of pump assemblies linked end to end.

9. The hydrocarbon extraction tool and pump combination of claim 1, wherein the sucker rod portion and cylinder portion are formed from a contiguous piece of material.

10. The hydrocarbon extraction tool and pump combination of claim 1, wherein the cylinder portion and sucker rod portion are separable.

11. A method of extracting hydrocarbons from an underground formation, the method comprising:

providing a hydrocarbon extraction tool comprising a tool encasement, the tool encasement comprising a substantially cylindrical tube having a hollow interior, an enclosed end, and a rod insertion end;

a sucker rod portion and cylinder portion, connected to each other sized to fit within the hollow interior space of the tool encasement, and to be moveable within the interior of the tool encasement;

a pressure actuated port located within the tool encasement, the pressure actuated port configured to permit fluid flow from within the interior of the tool encasement outside into a surrounding wellbore space, when the fluid pressure within the interior of the tool casement exceeds a pre-determined value; and a cylinder seal and a sucker rod seal, the cylinder seal and sucker rod seal configured to cooperatively isolate a portion of the volume of interior of the tool encasement from the remaining volume of the interior of the tool encasement and the surrounding wellbore space, wherein movement of the sucker rod and cylinder assembly within the tool encasement is effective to vary the volume and fluid pressure within the portion of the volume of the interior of the tool encasement thus isolated; and providing a pump assembly comprising a pump encasement, the pump encasement comprising an elongate substantially hollow cylinder, sized to admit a spiral rod, the spiral rod configured to produce a fluid flow when rotated within the interior of the pump encasement, and wherein the interior of the pump encasement is fluid contact with the wellbore space surrounding the pump encasement; and a drive mechanism, which engages the spiral rod and is operative to rotate the spiral rod in a desired direction, wherein rotation of the spiral rod is effective to produce a fluid flow within the wellbore space such that material is directed toward the end of the wellbore positioned at the surface of the earth;

placing the hydrocarbon extraction tool and at least one pump assembly into a wellbore in the vicinity of an underground formation from which hydrocarbons are to be extracted;

operating the extraction tool to pressurize the wellbore space such that hydrocarbon material is released from the underground formation; and operating the at least one pump assembly such that material in the wellbore space is moved towards the surface of the earth, where the material is removed from the wellbore prior to further processing.

12. The method of claim 11, wherein the pressure actuated port further comprises a nozzle body, with a nozzle opening therein, a shaft valve, and a bias member that produces a force effective to move the shaft valve into a position that occludes the nozzle opening, when the pressure differential between the wellbore space and the isolated volume within the tool encasement is less than a pre-determined value.

13. The method of claim 12, wherein the bias member comprises a spring.

14. The method of claim 11, wherein the sucker rod seal comprises an opening sized to fit the circumference of sucker rod portion, and which is effective to substantially prevent the flow of material past the sucker rod seal.

15. The method of claim 11, wherein the cylinder seal comprises a ring arranged circumferentially around the cylinder, and which is sized to engage the inner surface of the tool encasement, and which is effective to substantially prevent the flow of material past the cylinder seal.

16. The method of claim 11, wherein the drive mechanism comprises a motor housed within the pump encasement.

17. The method of claim 11, wherein the extraction tool comprises a plurality of pressure actuated ports.

18. The method of claim 11, comprising assembling plurality of pump assemblies linked end to end.

19. The method of claim 11, wherein the sucker rod portion and cylinder portion are formed from a contiguous piece of material.

20. The method of claim 11, wherein the cylinder portion and sucker rod portion are separable.

* * * * *